United States Patent [19]

Oehlenschläger et al.

[11] Patent Number: 4,461,054

[45] Date of Patent: Jul. 24, 1984

[54] CLEANING DEVICE FOR CLEANING THE INNER SURFACE OF A CONTAINER

[75] Inventors: Adam A. Oehlenschläger, Middelfart; Baldvin Einarsson, Odense, both of Denmark

[73] Assignee: AO-Engineering A/S, Denmark

[21] Appl. No.: 328,585

[22] PCT Filed: Apr. 30, 1981

[86] PCT No.: PCT/DK81/00046

§ 371 Date: Dec. 3, 1981

§ 102(e) Date: Dec. 3, 1981

[87] PCT Pub. No.: WO81/03140

PCT Pub. Date: Nov. 12, 1981

[30] Foreign Application Priority Data

May 1, 1980 [DK] Denmark ..... 1924/80

[51] Int. Cl.[3] ..... B08B 9/08

[52] U.S. Cl. ..... 15/304; 15/95; 15/306 B; 15/312 R

[58] Field of Search ..... 15/3.5, 95, 304, 306 B, 15/316 R

[56] References Cited

U.S. PATENT DOCUMENTS

| | | | |
|---|---|---|---|
| 1,644,384 | 10/1927 | Kondall | 15/95 X |
| 2,296,801 | 9/1942 | Thomas | 15/304 X |
| 2,725,641 | 12/1955 | Lindsay | 15/304 X |

*Primary Examiner*—Chris K. Moore

*Attorney, Agent, or Firm*—Scully, Scott, Murphy & Presser

[57] ABSTRACT

To provide for fully or partly automatic cleaning and to avoid pollution of the air in the surrounding room, a cleaning device for cleaning the inner surface of containers (7, 8) is arranged so that an upwardly open jacket (1, 2) may be moved upwards to enclose a container. A nozzle (21, 22) is fitted in the jacket for ejecting a granulate and a scavenging medium, respectively. At the upper part of the jacket (1, 2) there is mounted a ring-shaped brush (29, 30) to prevent dust from escaping. The containers (7, 8) are so journalled in this suspension that they can be rotated during the cleaning process.

16 Claims, 1 Drawing Figure

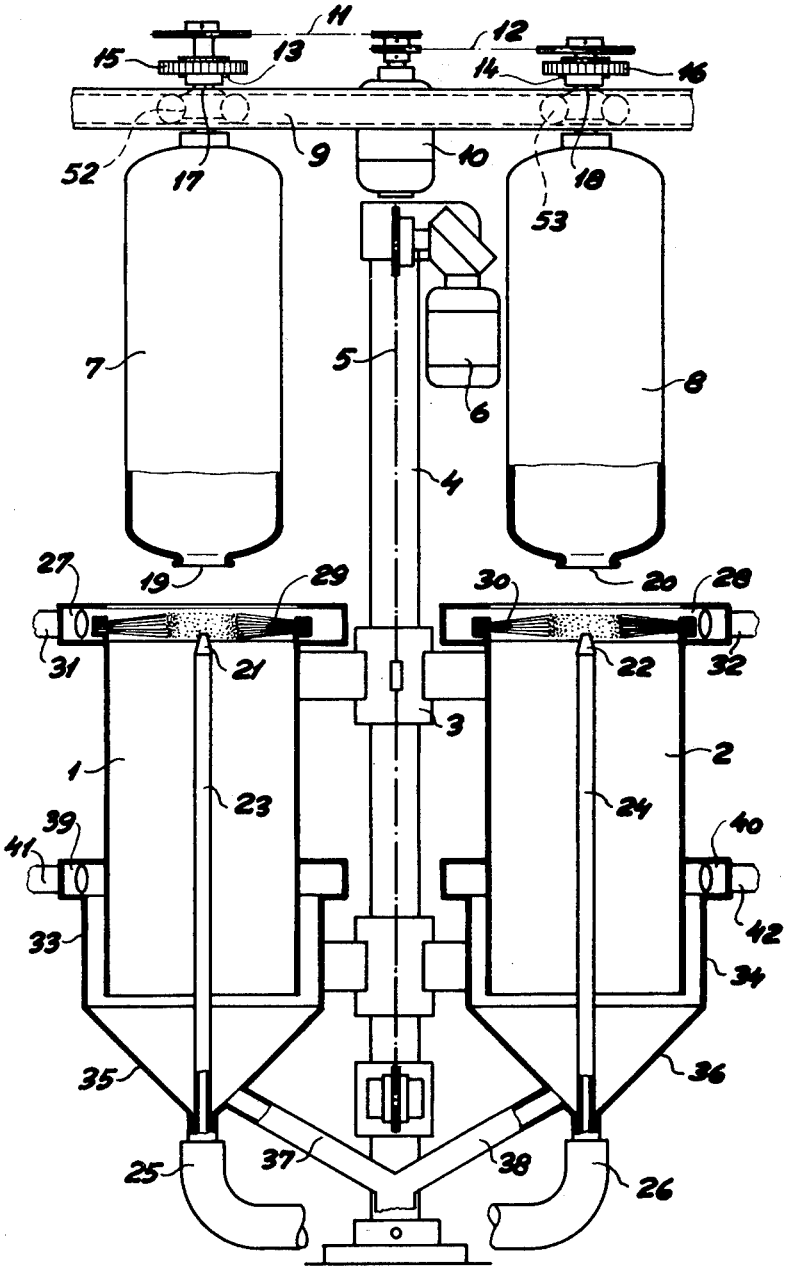
11
12
13
14
15
16
17
18
9
10
52
53
7
8
5
6
4
19
20
27
28
29
30
31
32
21
22
3
1
2
23
24
39
40
41
42
33
34
35
36
37
38
25
26

CLEANING DEVICE FOR CLEANING THE INNER SURFACE OF A CONTAINER

The invention relates to a cleaning device for cleaning the inner surface of a container which is fed along a transport path, suspended in the closed end of the container and with the opening of the container facing downwards.

The purpose of such a cleaning device is to clean the inner surface of a container so that this surface will be suitable for the application of a protective layer, e.g. a plastics layer. The object of the present invention is to construct the cleaning device so as to cause as little inconvenience as possible to the personnel which might be present in the vicinity of the device, i.e. to prevent the granulated cleaning means and dust from being hurled into the premises, and the cleaning device should at the same time desirably be so arranged that the entire operation can be performed automatically and with an efficiency as great as possible.

This is achieved according to the invention in that the cleaning device comprises a downwardly closed and upwardly open jacket which is arranged to be displaced upwardly to enclose a container to be cleaned and which contains a nozzle arrangement for ejecting a granulated cleaning means during the displacement of the jacket.

As the container to be cleaned is enclosed by said jacket during the ejection of the granulated material against the inner side of the container, the granulated material falls down to the bottom of the jacket and can immediately be removed from it and returned for use again.

An expedient embodiment of such a cleaning device is characterized in that it also comprises a corresponding, secondary jacked which is disposed adjacent said jacket and whose nozzle arrangement is adapted to eject a scavenging medium. This provides for the simultaneous treatment of two containers, one container being cleaned by means of the granulate, the other being scavenged to remove the particles that might stick more or less firmly to the inner side of the container.

To provide an additional safeguard against dust and small particles escaping into the room in which the cleaning device is mounted, particularly when the outer portion around the downwardly directed opening of the container is to be cleaned, it is expedient according to the invention that at least the first-mentioned jacket has at the upper edge a collar of dense bristles facing the axis of the jacket and disposed above the nozzle apertures of the nozzle arrangement. The bristles effectively retain dust particles, but to ensure that the bristles are cleaned again, it is expedient that the cleaning device is further arranged so that said collar of bristles is enclosed by an annular channel delimited from the interior of the jacket and connected to a suction device.

To permit complete automatization of the operation of such a cleaning device, said device may according to the invention also be arranged so that the sliding movement of the jacket or jackets is synchronized with the stepwise feeding of containers by the transport path, and that the operation of the nozzle arrangement is so synchronized with the displacement of the jacket that granulate and optionally also scavenging medium are ejected only during the period when said collar of bristles encloses a container.

The nozzle device itself is to be arranged so that it effectively sprays all internal parts of the container, but to achieve this in a simple and very effective manner with a simple arrangement of the nozzle, the cleaning device may according to the invention be arranged so that it comprises means for mutual, axial rotation of nozzle arrangement and container during the vertical displacement of the jacket.

As mentioned, the granulates used and also the scavenging medium used in the secondary jacked will be immediately removed at the bottom of the jacket, which may be provided with a discharge line for this material, but since rather large amounts of fine dust are formed, the cleaning device may according to the invention be arranged so that the lower end of the jacket is enclosed by an outer jacket to form a cylindrical sucking-out zone which at the lower edge of the jacket communicates with the interior of the jacket and at the top is connected to a suction device. The advantage is that this dust is sucked away right down from the bottom of the jacket and thus penetrates as little as possible up towards the brush-shaped collar, and that this dust is removed as effectively as possible from the granulate to be returned for use again.

The invention will be described below with reference to the drawing which diagrammatically shows a cleaning device according to the invention.

The drawing shows a cleaning device which comprises two juxtaposed jackets 1 and 2 which are interconnected and are slidably journalled on a column 4 by means of slides 3 so that the jackets may be moved upwardly and downwardly by means of a chain drive 5 and a motor 6.

By the upward displacement the jackets 1 and 2 are caused to enclose two containers 7 and 8 which are supported by cariages 52,53 (illustrated in phantom lines) which travel along running rail 9. A motor 10 drives gear wheels 13 and 14 via chain drives 11 and 12, said gear wheels 13 and 14 being located behind and in engagement with gear wheels 15 and 16 when the carriages have stopped as illustrated in the drawing. Gear wheels 15 and 16 are supported by the carriages 52,53 and are coupled to shafts 17 and 18, respectively, which are firmly connected to the containers 7 and 8, respectively, which may thus be rotated as long as they are in the position shown.

The containers 7 and 8 have downwardly facing openings 19 and 20, and when the jackets 1 and 2 are moved upwards, nozzles 21 and 22, respectively, move up through these holes. Tubes 23 and 24, respectively, connect the nozzles to supply lines 25 and 26, respectively, the supply line 25 being connected to a pressurized reservoir for a granulate, e.g. sand, the supply line 26 being connected to a pressurized reservoir for a cleaning medium. The granulate and the cleaning medium are thus ejected into the interior of the containers 7 and 8 during the upward movement of the jackets 1 and 2. At the upper part of the jackets 1 and 2 there is provided a ring-shaped channel 27 and 28, respectively, in which a ring-shaped brush 29 and 30, respectively, is fitted; these brushes enclose the containers 7 and 8 during the upward movement and thus prevent granulate and cleaning medium from escaping into the space outside. The channels 27, 28 are connected to suction lines 31 and 32 so that, also in this way, small amounts of dust will be sucked away from the brushes 29 and 30.

The lower part of the jackets 1 and 2 are provided with an outer jacket 33 and 34, respectively, which at the bottom terminates in a conical jacket 35 and 36, respectively, from whose bottom the deposited material may be sucked out through lines 37 and 38, respectively, and at the upper end of the outer jackets 33 and 34 there is provided an annular channel 39 and 40, respectively, which has a suction line 41 and 42, respectively. These lines provide for an easier suction of light particles which do not fall down to the bottom of the conical part 35 and 36, so care has been taken to ensure in every way that impurities do not escape into the room in which the device is located.

The arrangement of the nozzles 21 and 22 is not part of the invention, but an expedient embodiment of such a nozzle, described in Danish Pat. No. 144,876. As the containers 7 and 8 rotate during the upward movement of the jackets 1 and 2, the entire inner surface of the containers will be effectively sprayed. The feeding of the containers along the running rail 9 is effected stepwise so that each container stops opposite both of the two jackets 1 and 2, and will therefore first be sprayed with a granulate to clean the inner surface and then with a cleaning medium to remove residues of the granulate and other loose impurities. The various movements can of course be controlled manually, but may also be controlled electronically so as to provide for a completely automatic treatment of such containers. The said brushes 29 and 30 also have the function of serving to keep the containers 7 and 8 at rest during the entire process.

We claim:

1. An abrasive blasting device for cleaning the inner surface of a container which is fed along a transport path, said container being suspended by a closed end of the container with the opening of the container facing downwards, said device comprising: a downwardly closed and upwardly open jacket which is arranged to be displaced upwardly to enclose a container to be cleaned, a nozzle arrangement within said jacket for ejecting a granulated abrasive cleaning means during the displacement of the jacket, a collar of continuous and dense bristles encircling the open jacket and extending inwardly to cooperate with the container to be cleaned to close the jacket and thereby prevent the escape of the abrasive granules or dust resulting from their fragmentation.

2. An abrasive blasting device according to claim 1, which further comprises a corresponding second jacket which is disposed adjacent the first recited jacket, said second jacket having a nozzle arrangement adapted to eject a scavenging medium to purge the container of any residual granulated cleaning means when said container is moved from said first recited jacket to said second jacket.

3. An abrasive blasting device according to claim 2, wherein the movement of the jackets is synchronized with the stepwise feeding or containers along the transport path, with the operation of the nozzles synchronized with the displacement of the jackets to eject granulate and scavenging medium only during the period when said collar of bristles and a container has closed the first recited jacket.

4. An abrasive blasting device according to claim 1 or 2 wherein the device further comprises means for axial rotation of the container during the vertical displacement of the jacket.

5. An abrasive blasting device according to claim 1, wherein said collar of bristles is enclosed by an annular channel separated from the interior of the jacket and connected to a suction device.

6. An abrasive blasting device according to claim 1, wherein the lower end of the first recited jacket is enclosed by an outer jacket to form a cylindrical sucking-out zone which at the lower edge of the outer jacket communicates with the interior of the first recited jacket and at the top is connected to a suction device.

7. An abrasive blasting device according to claim 1 or 2 or 3 or 5 wherein the device also comprises a corresponding second jacket which is disposed adjacent said jacket and whose nozzle arrangement is adapted to eject a scavenging medium.

8. An abrasive cleaning device for cleaning the inner surface of a container which is fed along a transport path, said container being suspended by a closed end of the container with the opening of the container facing downwards, said device comprising a downwardly closed and upwardly open displaceable jacket which contains therein a nozzle arrangement for ejecting abrasive cleaning material during displacement of the jacket about the container, wherein the open end of the jacket comprises a collar of continuous dense bristles which cooperate with the container received in the jacket to close the jacket and prevent the escape of said abrasive cleaning material.

9. An abrasive blasting device according to claim 8 wherein the displacement of the jacketis synchronized with a stepwise feeding of a plurality of containers by the transport path, wherein the operation of the nozzle arrangement is so synchronized with the displacement of the jacket that ejection of the abrasive material takes place only during the period when said collar of bristles encloses a container.

10. An abrasive blasting device according to claim 1 wherein the lower end of the jacket is enclosed by an outer jacket to form a cylindrical sucking-out zone which at the lower edge of the jacket communicates with the interior of the jacket and at the top is connected to a suction device.

11. An abrasive blasting device according to claim 1, wherein said collar of bristles is enclosed by an annular channel separated from the interior of the jacket and connected to a suction device.

12. An abrasive blasting device according to claim 1, wherein means are provided to raise and lower the jacket and wherein means cooperating with the transport path are provided to rotate the container during the placement of the jacket.

13. An abrasive cleaning device for cleaning and scouring the inner surface of a container, said device comprising:

(a) means for transporting a container to be cleaned, said means suspending a container by a closed end, with an open end of the container facing downwardly;

(b) a downwardly closed and upwardly open first jacket for surrounding the container to be cleaned;

(c) a first nozzle arrangement mounted within said jacket for ejecting abrasive cleaning granules;

(d) means for moving said jacket and said nozzle upwardly to enclose the container and direct the nozzle arrangement into the open end of the container;

(e) means for forcing granulated and abrasive cleaning material through said nozzle after the nozzle has entered the container, said granulated material thereby cleaning and scouring the inner surface of the container;

(f) a collar of continuous dense bristles surrounding the open end of the jacket and extending inwardly above said nozzle to cooperate with the container to close the upper opening of the first jacket and thereby prevent the escape of granulated abrasive cleaning material or dust resulting from their fragmentation.

14. An abrasive cleaning device as claimed in claim 13 wherein the collar of bristles is enclosed by annular channel, said annular channel being connected to a suction means.

15. An abrasive cleaning device as claimed in claim 13 wherein said transport means rotates a container as the first jacket and the nozzle are moved upwardly.

16. An abrasive cleaning device as claimed in claim 13 or 14 or 15 wherein said device also comprises:

(a) a second jacket and a second nozzle mounted adjacent the first jacket and nozzle;

(b) means for transporting the container in a stepwise mode to suspend the container above the first jacket and then above the second jacket;

(c) means for moving the second jacket and nozzle upwardly as said first jacket and nozzle are moved upwardly;

(d) means for ejecting a scavenging medium through said second nozzle to clean the container of any residual granulated abrasive cleaning material when the second nozzle is raised upwardly into the container.

* * * * *